US005862689A

United States Patent [19]

Wen

[11] Patent Number: 5,862,689

[45] Date of Patent: Jan. 26, 1999

[54] DRAWER LOCK IMPROVEMENT

[76] Inventor: Cheng-Kan Wen, No.1, GuangHwa Rd., SanChung City, Taipei Hsien, Taiwan

[21] Appl. No.: 949,895

[22] Filed: Oct. 14, 1997

[51] Int. Cl.[6] ..... E05B 65/46

[52] U.S. Cl. ..... 70/85; 312/219; 292/DIG. 18

[58] Field of Search ..... 70/85–87, 78–84; 292/DIG. 18, 29, 40, 46, 52, 161; 312/215–221

[56] References Cited

U.S. PATENT DOCUMENTS

| | | | |
|---|---|---|---|
| 921,895 | 5/1909 | Sampson | 70/85 |
| 1,036,345 | 8/1912 | Sampson | 70/85 |
| 1,178,724 | 4/1916 | Hunter | 70/85 |
| 1,951,628 | 3/1934 | Prost | 70/85 |
| 2,547,513 | 4/1951 | Wikman | 70/85 X |
| 3,976,343 | 8/1976 | Breckner et al. | 312/219 |
| 4,811,579 | 3/1989 | Lyons et al. | 70/85 |

FOREIGN PATENT DOCUMENTS

| | | | |
|---|---|---|---|
| 955876 | 1/1950 | France | 70/85 |
| 2449598 | 4/1976 | Germany | 70/85 |
| 243888 | 9/1990 | Japan | 70/85 |

*Primary Examiner*—Suzanne Dino Barrett
*Attorney, Agent, or Firm*—W. Wayne Liauh

[57] ABSTRACT

An improvement in a drawer lock of a cabinet includes a cylinder, a trigger bar, a fixing block, a sliding block, a latch hook, a first elastic member and a latch mechanism. The latch mechanism has a clutch pivotally engaged with a latch bar. A second elastic member keeps the clutch to be engaged with the latch bar at a preset angle. The latch hook of a closing drawer can wedge the latch bar to turn an angle smoothly while the clutch and the sliding block remain stationary, so as to prevent causing any damage to the latch hook even when the cabinet is in a locked position.

2 Claims, 6 Drawing Sheets

DRAWER LOCK IMPROVEMENT

BACKGROUND OF THE INVENTION

1. Field of the Invention

The present invention relates to an improvement in drawer locks and, more particularly, to an improvement in drawer locks for use in a cabinet which contains more than one drawer. The present enables the drawn out drawers to be closed and automatically locked again after the cabinet has been latched and locked.

2. Description of the Prior Art

In a conventional tools or articles cabinet, there is usually provided casters at the bottom thereof to enhance its mobility. In addition to this, the drawer may be opened and drawn out for easily accessing things held in the drawer.

However when more than one drawers are opened and drawn out, it might result in the entire cabinet being tilted over to one side because of the unbalanced weight thus causing people to be hurt. To prevent this from happening, there is often provided a safety drawer lock which allows only one drawer to be opened and drawn out at a time. FIGS. 1 and 2 show such an example. It includes a cylinder 1, a trigger bar 2, a fixing block 3, a sliding block 4, a first elastic member 5, a latch hook 6 and a latch bar 9. The rear end of the cylinder 1 has a first slot 11 engaging with a front end of the trigger bar 2. The rear end of the trigger bar 2 goes through the fixing block 3 and engages with the sliding block 4 which is slidable transversely. The sliding block 4 is a [-shaped frame having an opening 41 running through the top and bottom flanges, and two spaced second and third slots 42 and 43 formed in a lateral wall. The trigger bar 2 has its rear end engaged with the second slot 42. The third slot 43 is engageable with a spring blade 44 which is fixed to an inside surface of the sliding block 4. The latch bar 9 is an elongated plank with a plural number of latch openings 91. At a lateral side of the latch bar 9, there is provided a spindle 92 with two ends extending out of the plank. At another lateral side of the latch bar 9, there is a strut 93 with one end extending out of the plank. The first elastic member 5 has two ends engaging respectively with the strut 93 and the fixing block 3. The latch hook 6 fixed to a drawer 7 is a plate with a hooking slot 61, a left slant edge 63, a right slant edge 64 and a finger 62.

When in use, a key is inserted into the cylinder 1 and turned clockwise. The trigger bar 2 is also being turned and moves the sliding block 4 to the left. The spring blade 44 pushes the strut 93 and turns the latch bar 9 to a preset angle clockwise. The latch opening 91 disengages with the finger 62 on the latch hook 6. The drawer 7 is then free to open and draw out.

When one of the drawers is drawn out, the left slant edge 63 will move against the latch bar 9. With the aid of the first elastic member 5, the latch bar 9 is pushed to the locking position to lock all other drawers that are not opened.

By means of such arrangements, only one drawer is allowed to open and be drawn out at one time. Therefore, it can prevent two or more drawers from being drawn out and causing the cabinet to tilt, because of unbalanced weight. However when a user incidentally turns the cylinder 1 counter clockwise, the trigger bar 2 will turn and move the sliding block 4 to the right, the strut 93 will be moved to turn the latch bar 9 counterclockwise. It becomes to be in a locking position. Then the opened and drawn out drawer cannot be closed unless the cylinder 1 is opened again. When trying to close the opened drawer by force, the latch hook 6 will hit the latch bar 9 and may become damaged. It could become an annoyance to users.

SUMMARY OF THE INVENTION

In view of aforesaid shortcomings, it is therefore an object of this invention to provide a drawer lock improvement which enables a drawn out drawer to close and lock again smoothly without causing any damage even when the lock of the cabinet is at a locked condition. The drawer lock according to this invention includes a cylinder, a trigger bar, a fixing block, a sliding block, a first elastic member and a latch means. The latch means has a clutch elastically engaging with a latch bar 9 so that the latch bar can lock the drawers under a locked condition but still may be opened by force without incurring damages.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
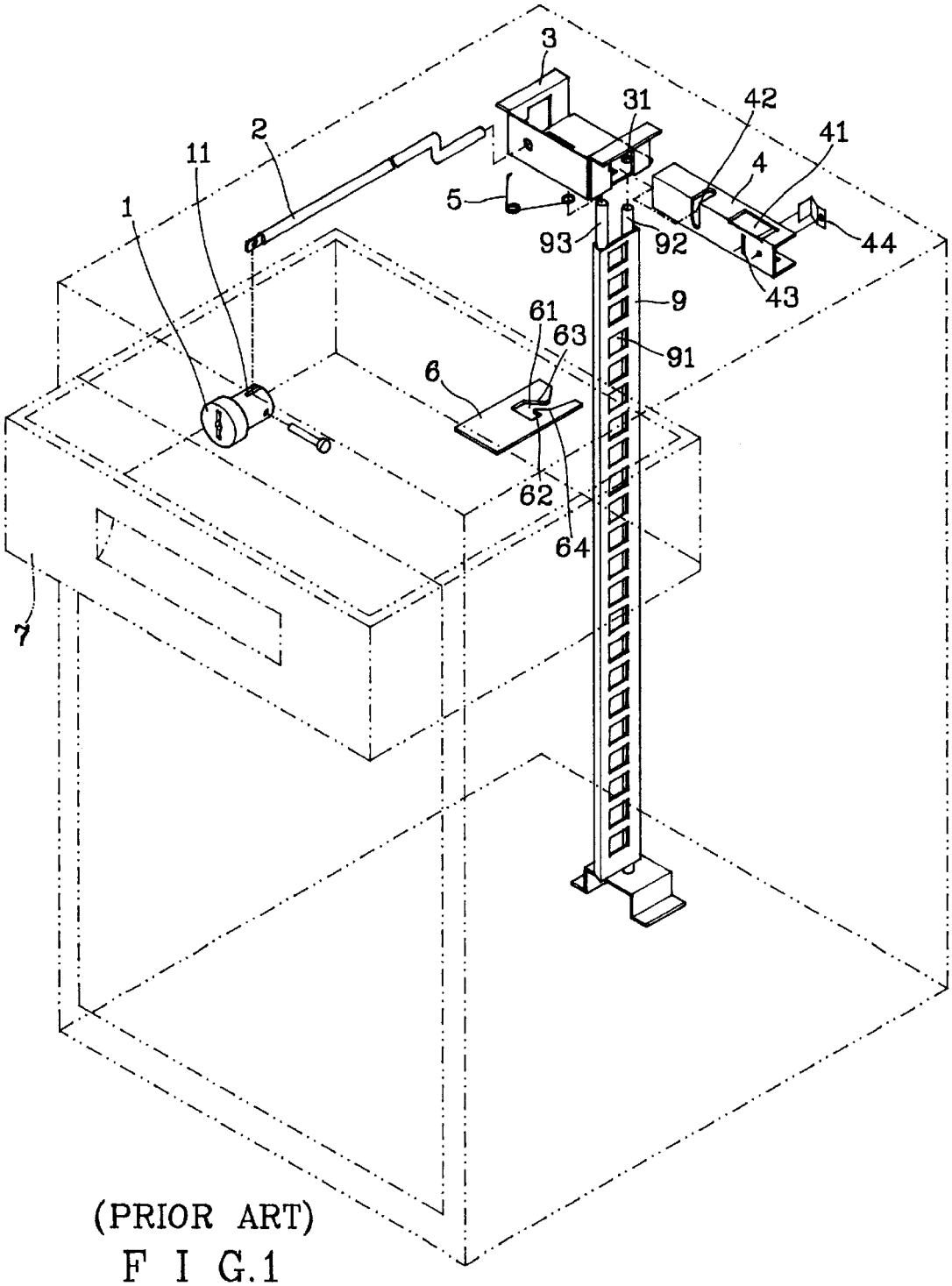
(PRIOR ART) F I G.1
FIG. 1 is an exploded view of a conventional drawer lock.
Figure 2:
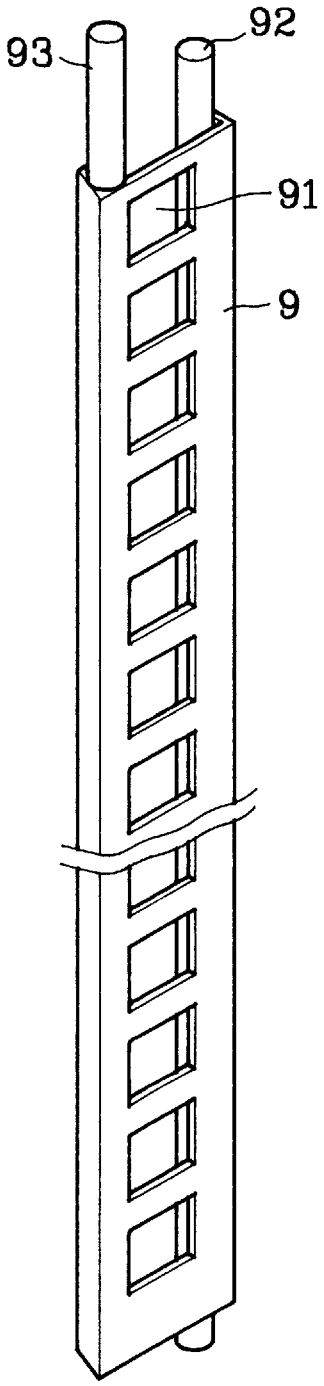
(PRIOR ART) F I G.2
FIG. 2 is a fragmentary perspective view of a conventional latch bar.
Figure 3:
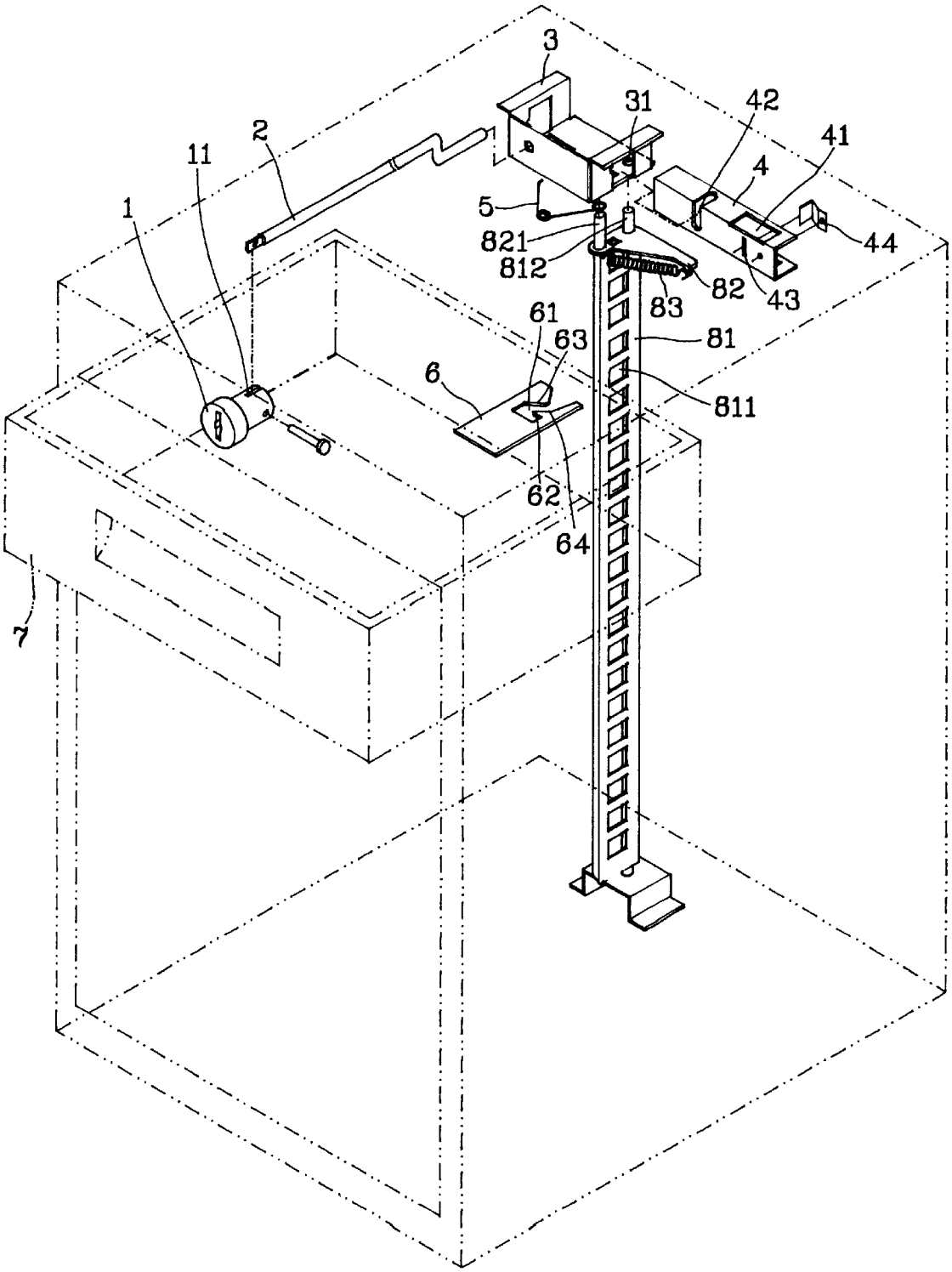
FIG. 3 is an exploded view of this invention.
Figure 4:
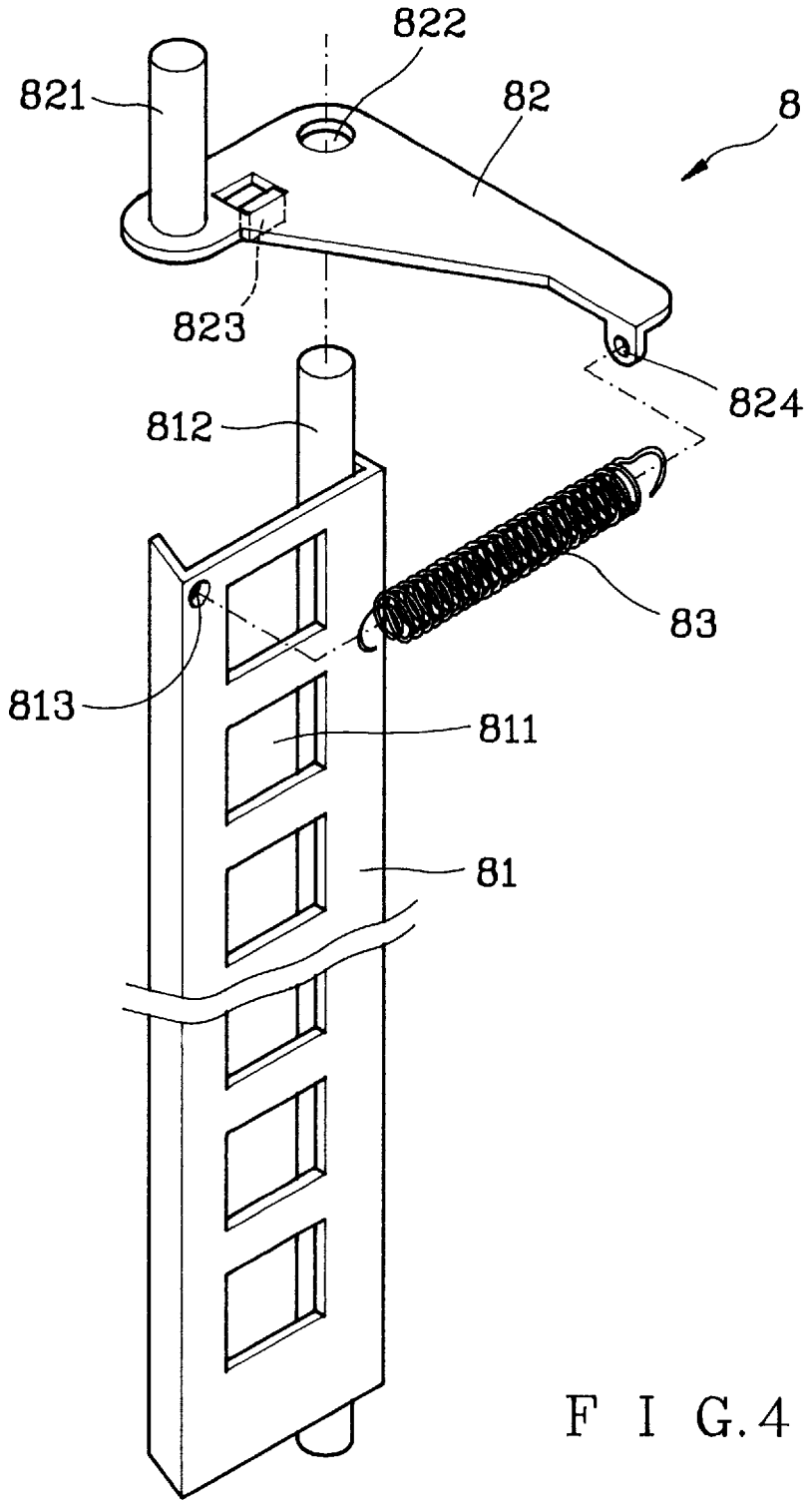
FIG. 4 is an exploded view of a latch means of this invention.

Referring to FIGS. 3 and 4, this invention includes a cylinder 1, a trigger bar 2, a fixing block 3, a sliding block 4, a first elastic member 5, a latch hook 6 and a latch means 8. The rear end of the cylinder 1 has a first slot 11 engaging with a front end of the trigger bar 2. The rear end of the trigger bar 2 goes through the fixing block 3 and engages with the sliding block 4 which is slidable transversely. The sliding block 4 is a [-shaped frame having an opening 41 running through the top and bottom flanges, and two spaced second and third slots 42 and 43 formed in a lateral wall. The trigger bar 2 has its rear end engaged with the second slot 42. The third slot 43 is engageable with a spring blade 44 which is fixed to an inside surface of the sliding block 4. The latch means 8 includes an elongated latch bar 81, which is normal to the sliding direction of the sliding block 4 and which has a plural number of spaced latch openings 811 formed therein, a spindle 812 located on one lateral edge of the latch bar 81 with two ends of the spindle 812 extending out of the latch bar 81, a clutch 82, and a second elastic member 83. The clutch 82 is horizontally located above the latch bar 81 and has a vertical strut 821 at one end, a spindle opening 822 spaced from the strut 821 for engaging with the spindle 812. There is a downward first stud 823 located between the strut 821 and the spindle opening 822 and a downward second stud 824 spaced from the first stud 823. The second elastic member 83 engages with the second stud 824 at one end and engages, at another end, with an aperture 813 formed in the latch bar 81. The latch hook 6 is a plate with a hooking slot 61, a left slant edge 63, a right slant edge 64 and a finger 62. The latch hook 6 is fixed to a drawer 7. The spindle 812 runs vertically across the entire cabinet and has its both ends pivotly engaged respectively with second openings 31 formed respectively in the fixing block 3 located at the top and bottom walls of the cabinet.

When a drawer is being opened and drawn out, the latch hook 6 will turn and then restore the latch bar 81 to lock all other drawers remained inside the cabinet like a conventional drawer lock set forth in the prior art.

Figure 5:
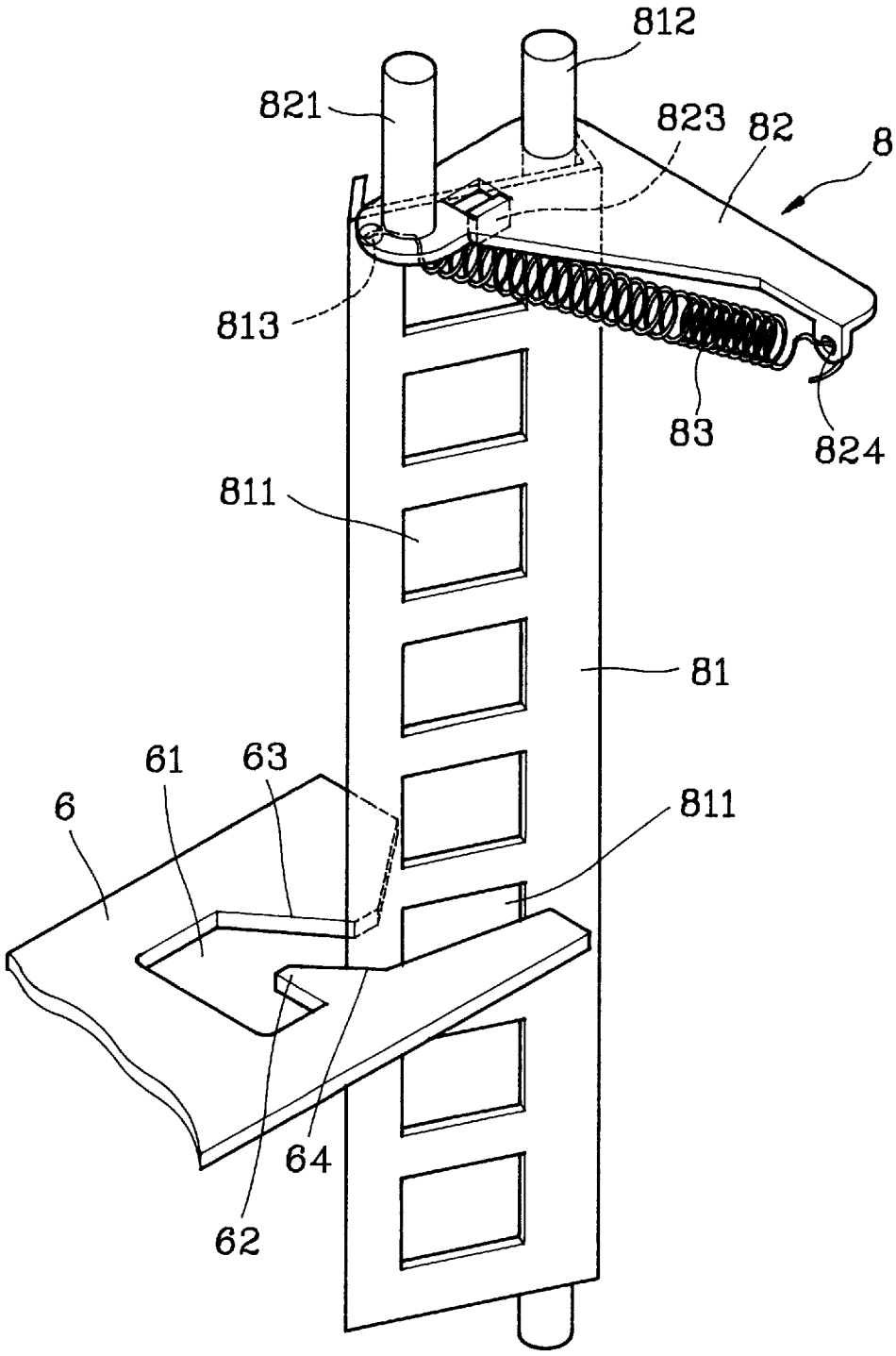
FIG. 5 is a pictorial view of a latch means during a drawer is being pushed into a cabinet.
Figure 6:
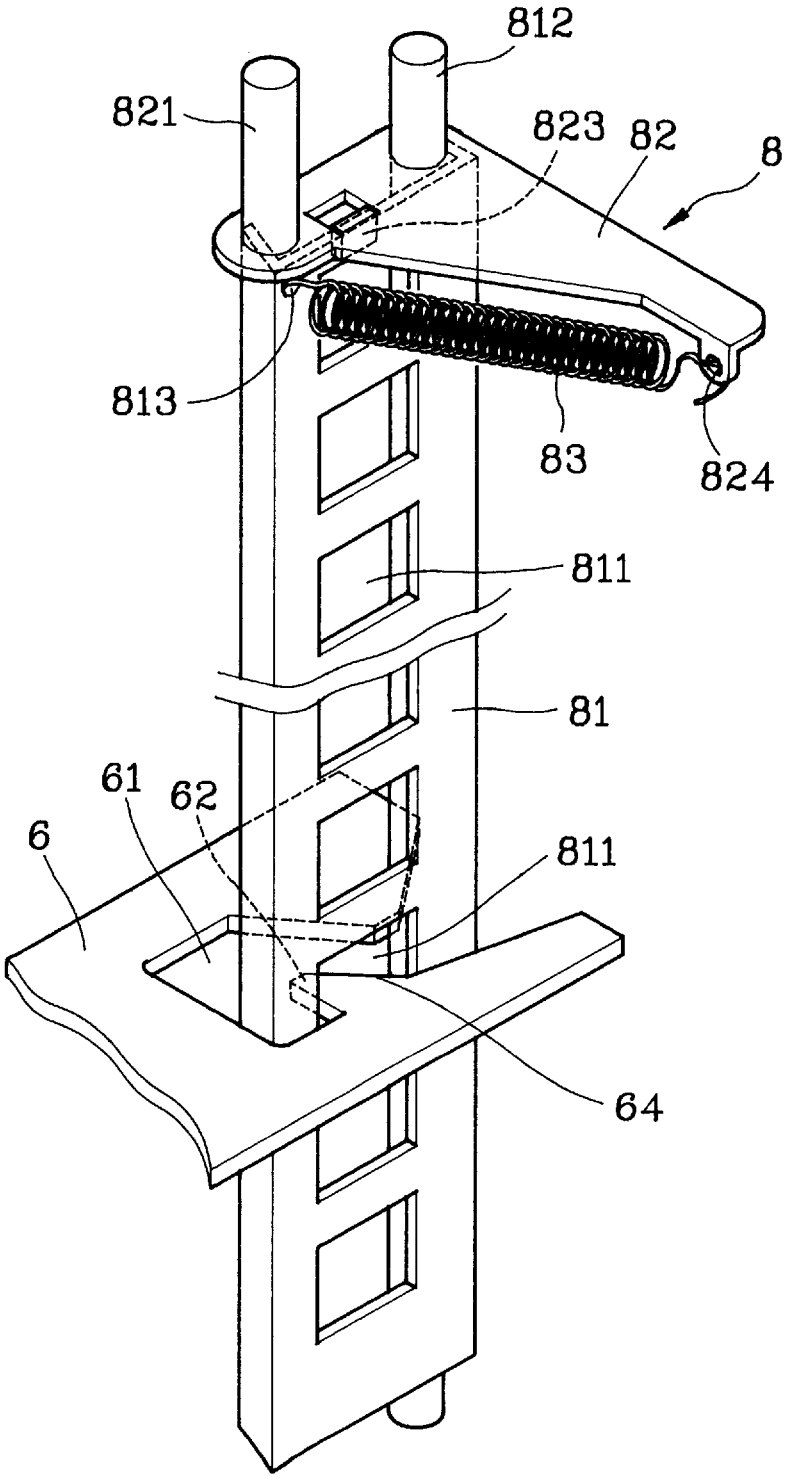
FIG. 6 is a pictorial view of a latch means after a drawer is being pushed in a cabinet and locked.

Referring to FIGS. 5 and 6, when turning the cylinder 1 counterclockwise to lock the drawer 7, an edge of the opening 41 of the sliding block 4 pushes the strut 821 to swing the latch bar 81 about the spindle 812. The latch opening 811 will engage with the latch hook 6. One edge of the latch bar 81 is held in the hook slot 61 and is retained there by the finger 62. It becomes to be in a locked position (FIG.6).

If another drawer 7 is being drawn out and becomes open when the cylinder 1 is at a locked position, pushing the drawer 7 into the cabinet, the right slant edge 64 will wedge through the latch bar 81 smoothly, while the latch bar 81 will be turned clockwise under the tension of the second elastic member 83 so that the latch bar 81 will engage with the latch hook 6 again (Referring to FIG. 5). Once the drawer 7 is locked, the second elastic member 83 will keep the latch bar 81 securely at the locked position. Therefore with the provision of the clutch 8, this invention allows an open drawer to close and lock again smoothly and easily even under a locked condition.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art.

For example, the clutch 82, the second elastic member 83, the engaging aperture 813 and the second stud 824 may be substituted by other suitable means known in the art.

Accordingly, the appended claims are intended to cover all embodiments which do not depart from the spirit and scope of the invention.

What is claimed is:

1. An improvement in a drawer lock for cabinet, comprising:

a cylinder located in the cabinet to receive a key having a first slot at a rear end thereof;

a trigger bar located behind the cylinder having a front end engaging with the first slot and a back end;

a fixing block located behind the trigger bar having a first aperture to receive the back end of the trigger bar;

a [-shaped sliding block engageable with the back end of the trigger bar and being moveable transversely in the fixing block;

a latch hook fixed to a drawer having a hooking slot; and a latching means engageable with the latch hook for locking or releasing the drawer, including:

an elongated latch bar normal to the moving direction of the sliding block having a plurality of latch openings and two lateral edges, one lateral edge engaged with a pivotal spindle which has an extended top end and an extended bottom end, another lateral edge having a second aperture in a top portion thereof, the top end of the pivotal spindle being pivotally engageable with the fixing block;

a clutch located above the latch bar having a spindle opening to house the top end of the spindle, an upward strut spaced from the spindle opening engageable with the sliding block and a downward stud spaced from the upward strut;

and an elastic member engaging with the downward stud at one end thereof and with the second aperture at another end thereof;

wherein the latch hook is able to move the latch bar to turn about the spindle without moving the sliding block and the clutch for allowing an opening drawer to be closed and locked again when the cabinet is at locking condition.

2. An improvement in a drawer lock of claim 1, wherein the elastic member is a spring.

* * * * *